US011007111B2

(12) United States Patent
Paul

(10) Patent No.: US 11,007,111 B2
(45) **Date of Patent: *May 18, 2021**

(54) GUM SOOTHER

(71) Applicant: Lori Ann Paul, Odessa, TX (US)

(72) Inventor: Lori Ann Paul, Odessa, TX (US)

( * ) Notice: Subject to any disclaimer, the term of this patent is extended or adjusted under 35 U.S.C. 154(b) by 92 days.

This patent is subject to a terminal disclaimer.

(21) Appl. No.: 16/365,968

(22) Filed: Mar. 27, 2019

(65) Prior Publication Data

US 2019/0216677 A1 Jul. 18, 2019

Related U.S. Application Data

(63) Continuation-in-part of application No. 15/387,480, filed on Dec. 21, 2016, now Pat. No. 10,265,241, which is a continuation-in-part of application No. 15/197,512, filed on Jun. 29, 2016, now Pat. No. 9,597,256.

(51) Int. Cl.

| | |
|---|---|
| ***A61H 13/00*** | (2006.01) |
| ***A61H 23/02*** | (2006.01) |
| ***A61H 1/00*** | (2006.01) |

(52) U.S. Cl.

CPC ..... *A61H 13/00* (2013.01); *A61H 1/00* (2013.01); *A61H 23/02* (2013.01); *A61H 23/0263* (2013.01); *A61H 2201/0107* (2013.01); *A61H 2201/0153* (2013.01); *A61H 2201/0173* (2013.01); *A61H 2201/1215* (2013.01); *A61H 2201/1635* (2013.01); *A61H 2201/1645* (2013.01); *A61H 2201/1671* (2013.01); *A61H 2201/1685* (2013.01); *A61H 2201/5025* (2013.01); *A61H 2201/5033* (2013.01); *A61H 2203/03* (2013.01); *A61H 2205/026* (2013.01)

(58) Field of Classification Search

CPC ..... A61H 23/0263; A61H 2201/0153; A61H 2201/1215; A61H 13/00; A61H 23/00; A61H 23/02; A61H 23/0254; A61H 2201/00; A61H 2201/0157; A61H 2201/169; A61H 2201/1692; A61H 2201/1695

See application file for complete search history.

(56) References Cited

U.S. PATENT DOCUMENTS

| | | | | | |
|---|---|---|---|---|---|
| 3,669,117 | A | * | 6/1972 | Herbst | A61J 17/02 606/235 |
| 4,192,307 | A | * | 3/1980 | Baer | A23G 3/34 606/236 |
| 4,716,902 | A | | 1/1988 | Swartz | |
| 5,160,344 | A | | 11/1992 | Werton | |
| 5,292,335 | A | | 3/1994 | Shin | |
| 5,606,871 | A | | 3/1997 | Hansen et al. | |
| 5,649,964 | A | | 7/1997 | Berman et al. | |
| 5,693,073 | A | | 12/1997 | Glick et al. | |
| 5,711,759 | A | | 1/1998 | Smith | |
| 5,902,322 | A | | 5/1999 | Scagliotti | |
| 6,053,881 | A | | 4/2000 | Boodramsingh | |

(Continued)

*Primary Examiner* — Steven O Douglas
(74) *Attorney, Agent, or Firm* — Rao DeBoer Osterrieder PLLC; Dileep P. Rao

(57) ABSTRACT

A gum soother with a vibrating and detachable head. The gum soother can have a wand or spherical body with a vibrating device inside. The vibrating device can be in mechanical communication with one or more detachable heads. The detachable heads can have a variety of chew tips to soothe gums.

13 Claims, 3 Drawing Sheets

(56) References Cited

U.S. PATENT DOCUMENTS

| | | | | |
|---|---|---|---|---|
| 6,264,678 | B1 | 7/2001 | Landers | |
| 6,468,294 | B2 | 10/2002 | Griffith | |
| 6,591,140 | B2 | 7/2003 | Strome | |
| 7,211,102 | B2 | 5/2007 | DeSousa et al. | |
| D593,203 | S | 5/2009 | Kliegman | |
| 8,182,510 | B2 | 5/2012 | Brabant et al. | |
| 9,597,256 | B1 | 3/2017 | Paul | |
| 9,855,187 | B2 | 1/2018 | Martin et al. | |
| 2003/0171647 | A1 | 9/2003 | Garland | |
| 2007/0244416 | A1 | 10/2007 | Sobin et al. | |
| 2010/0230372 | A1* | 9/2010 | Lo | A61J 9/08 215/11.1 |
| 2012/0179077 | A1 | 7/2012 | Tuck et al. | |
| 2013/0123675 | A1* | 5/2013 | Oki | A61H 13/00 601/112 |
| 2013/0178769 | A1* | 7/2013 | Schmidt | A61H 19/34 601/46 |

* cited by examiner

GUM SOOTHER

CROSS REFERENCE TO RELATED APPLICATIONS

The present application is a Continuation in Part and claims priority to and the benefit of co-pending U.S. patent application Ser. No. 15/387,480 filed on Dec. 21, 2016, tilted "INTEGRAL GUM SOOTHER", which is a Continuation in Part of U.S. patent application Ser. No. 15/197,512 filed on Jun. 29, 2016, titled "INTEGRAL ONE PIECE GUM SOOTHER," which issued as U.S. Pat. No. 9,597,256 on Mar. 21, 2017. These applications are incorporated herein in their entireties.

FIELD

The present embodiments generally relate to a gum soother.

BACKGROUND

A need exists for a device that toddlers can use to massage gums during the teething process.

A need exists for a device that pets can use to massage gums during the teething process.

A need exists for a device which can deliver a soothing vibration in a safe and effective manner.

The present disclosure meets these needs.

BRIEF DESCRIPTION OF THE DRAWINGS

The detailed description will be better understood in conjunction with the accompanying drawings as follows.

Figure 1:
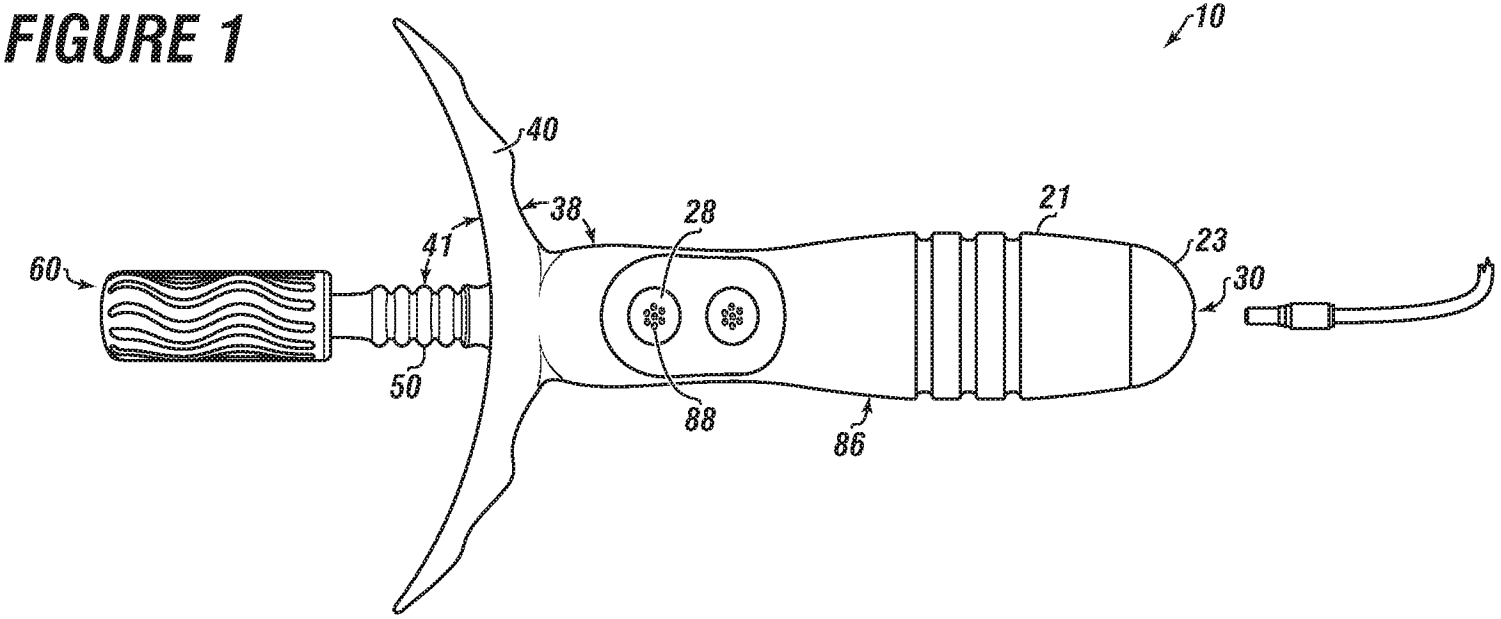
FIG. 1 depicts a side view of a gum soother according one or more embodiments.

The present embodiments are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The word "about", when referring to values, means plus or minus 5% of the stated number.

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

When methods are disclosed or discussed, the order of the steps is not intended to be limiting, but merely exemplary unless otherwise stated.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a gum soother

In embodiments, the gum soother can have a wand, a stem and a detachable head.

The wand can have a motor, a power supply, a handle, and a vibrating device within the handle. The handle can comprise an ergonomic grip formed on an outer surface of the wand.

The motor and power supply can be any chosen by persons having ordinary skill in the art. The vibrating device can also be chosen to fit a specific embodiment. A preferred embodiment utilizes an eccentric weight rotated by the motor to create a vibration.

A stem can be in mechanical communication with the vibrating device extending from the wand and in mechanical communication with a detachable head. The stem can transfer the vibration to the detachable head.

The stem can be sized and composed of materials as desired by persons having ordinary skill in the art.

The detachable head can have a chew tip. In embodiments, the chew tip can be configured to sustain a temperature cooler than ambient temperature. A removable cap can be mounted to the detachable head. The chew tip can have a plurality of facets and a plurality of ridges to aid in soothing the gums. In embodiments, the chew tip can also be detachable.

In embodiments, the gum soother can also have a mouth guard. The mouth guard can be placed either on the detachable head, or on the wand as desired. In embodiments, a plurality of vents can be formed in the mouth guard. The mouth guard can be curved to conform to lips of a user. In embodiments, the mouth guard can be detachable.

In embodiments, an internal casing contained inside the wand can house the power supply. The power supply can be a battery, a solar cell, a capacitor, or any other power supply known to persons having ordinary skill in the art.

The gum soother can also have a charging port in electronic communication with the power supply for recharging the power supply and/or providing a USB port connection.

In embodiments, the power supply can be in communication with a clock or a timer, wherein a desired amount of time can be set to the clock or start the timer to vibrate the gum soother for a period of time and shut off thereafter. In embodiments, the clock or time can be disposed on the gum soother, such as on the wand.

An alternate embodiment of the gum soother can have a body, a plurality of heads, a motor, a power supply connected to the motor, a vibrating device within the body in mechanical communication with the motor, and a plurality of stems in mechanical communication with the vibrating device extending from the body, wherein each head of the plurality of heads is in communication with a stem of the plurality of stems.

The body can be substantially spherical or polyhedral, and each head of the plurality of heads can be detachable. Each head can also comprise a chew tip. The chew tip can be various shapes, and detachable in embodiments.

Turning now to the Figures, FIG. 1 depicts a side view of a gum soother according one or more embodiments.

The gum soother 10 can have a wand 21. The wand 21 can have an on/off switch 28 with a switch locator 88 so that a user can easily locate the on/off switch 28. The switch locator 88 can be a series of bumps or depressions on the on/off switch 28. The on/off switch can be actuated in any manner known to persons having ordinary skill in the art.

An ergonomic grip 86 can be formed on an outer surface of the wand 21, allowing a user to obtain a sure and comfortable grip on the wand 21. In embodiments, the ergonomic grip 86 can be tapered. In other embodiments, the ergonomic grip 86 can have finger depressions for each finger of a user holding the wand 21.

A removable detachable cap 23 can be mounted to the wand 21. The removable detachable cap can provide easy access for the changing of a power supply, such as a battery.

The removable detachable cap 23 can include a safety screw to ensure a child cannot swallow, choke or be injured from the use of the device. Unlike other devices with loose caps, the gum soother can prevent choking in children, while stimulating their gums.

The wand 21 can have a charging port 30, which can penetrate the removable detachable cap 23 to allow for easy charging of the power supply. In embodiments, the power supply can be an onboard power supply, which can be a rechargeable battery.

In embodiments, the batteries can be from 2 AAA to 4 AAA DC batteries connected together. In other embodiments, the batteries can be from 1 AA to 2 AA DC batteries or a single 9-volt DC battery.

The charging port 30 can be a USB compatible port, such as a mini USB compatible port. The charging port can be an A/C port, a D/C port or any other style of charging port.

A mouth guard 40 can be connected to the wand 21. The mouth guard 40 can extend at a first angle 38. The first angle 38 can range from 40 degrees to 120 degrees from the wand 21.

In embodiments, the mouth guard can be made from a harder, thicker silicone rubber material than the wand 21.

A detachable head 50 can be connected to the wand 21. The detachable head 50 can be oriented at a second angle 41 from the mouth guard 40. The second angle 41 can range from 40 degrees to 120 degrees.

A chew tip 60 can be connected to the detachable head 50. The chew tip 60 can be heated or cooled dependent on the user's preference.

In embodiments, the chew tip 60 can have a larger outer diameter than the detachable head 50. The chew tip 60 should be sufficiently large in outer diameter to cover gums of a child without being overly large in the child's mouth to prevent chocking or other bodily harm to a child while simultaneously providing comfort to the mouth of the child.

Figure 2:
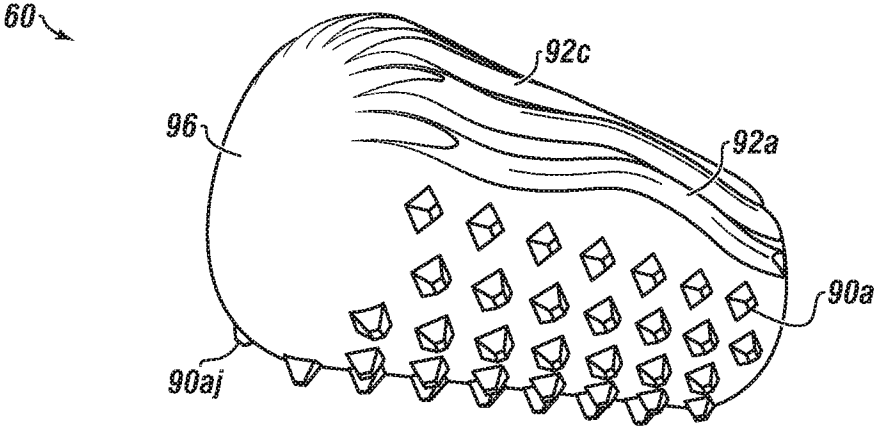
FIG. 2 depicts detailed view of a chew tip of the gum soother according to one or more embodiments.

FIG. 2 depicts detailed view of a chew tip of the gum soother according to one or more embodiments.

The chew tip 60 can have an outer surface 96. In embodiments, the chew tip 60 can be tapered. In embodiments, the chew tip 60 can be cylindrical in shape.

A plurality of facets 90*a*-90*aj* and a plurality of ridges 92*a*-92*c* can be formed on the chew tip 60.

In embodiments, the plurality of facets 90*a*-90*aj* can extend from the outer surface of the chew tip 60 from 0.1 mm to 0.3 mm and have a density of facets ranging from 6 facets per $cm^2$ to 12 facets per $cm^2$.

The plurality of facets can be any geometric shape such as diamond shaped, pyramid shaped, round shaped or combinations thereof. The plurality of facets can be curvilinear.

In embodiments, the plurality of facets can be filled and solid to enable a child to apply pressure to the gums for comforting compression.

In embodiments, the plurality of facets can be molded from the same material as the outer surface 96 of the chew tip 60. The plurality of facets can be made from any suitable material as determined by persons having ordinary skill in the art.

In embodiments, the plurality of ridges 92*a*-92*c* can extend from the outer surface 96 of the chew tip 60. The plurality of ridges can extend from the outer surface from 0.1 mm to 0.3 mm and have a density ranging from 2 ridges to 6 ridges per centimeter of the outer surface.

In embodiments, the plurality of ridges can be parallel to each other. In other embodiments, the plurality of ridges can be grouped, and a first group of parallel ridges can be at a right angle to a second group of parallel ridges.

In other embodiments, the plurality of ridges can be curvilinear or wavy.

Each ridge of the plurality of ridges can have a thickness ranging from about 0.08 mm to about 0.12 mm.

Figure 3:
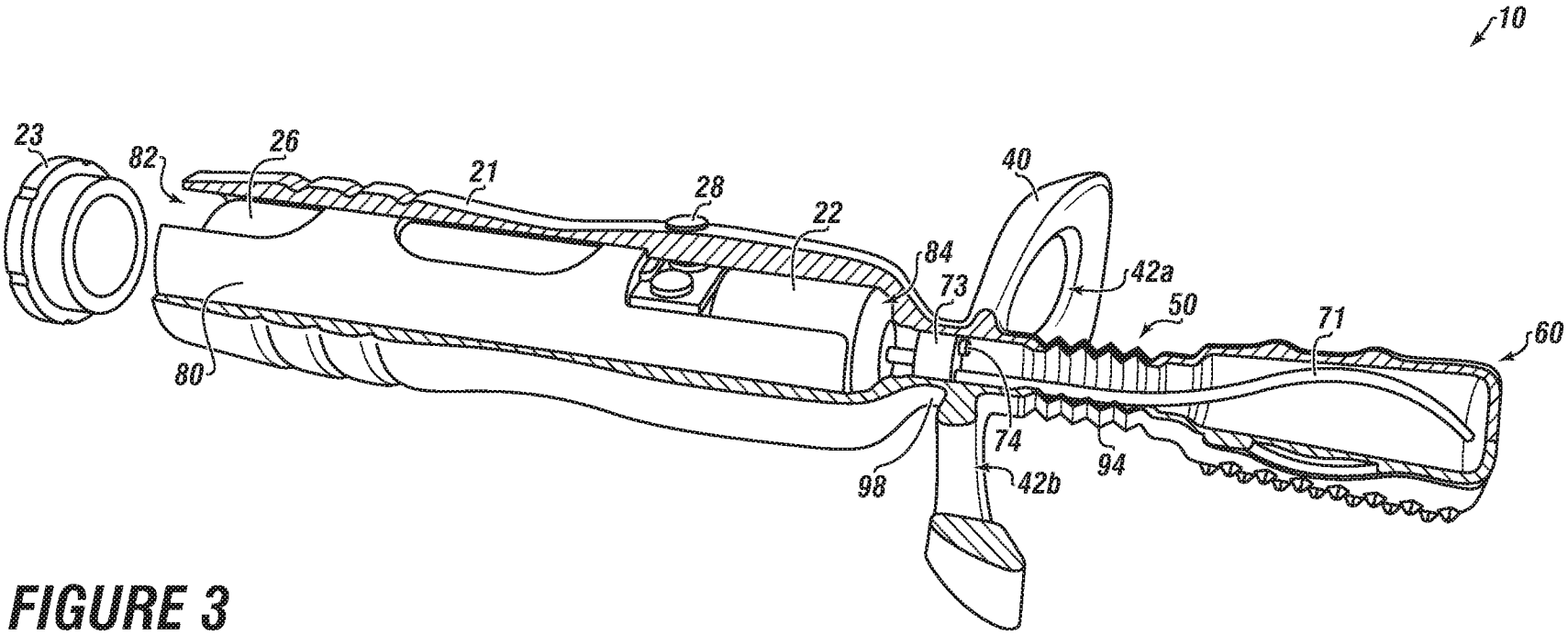
FIG. 3 depicts a partial cut view of the gum soother according to one or more embodiments.

FIG. 3 depicts a partial cut view of the gum soother according to one or more embodiments.

The gum soother 10 can have a wand 21. In embodiments, the wand 21 can have a length from about 7 cm to about 10 cm and a diameter ranging from about 1.5 cm to about 3 cm.

In embodiments, the wand 21 can be a molded one-piece unit formed from any suitable material as determined by persons having ordinary skill in the art.

In embodiments, the wand 21 can have a wall thickness from about 0.05 mm to about 0.20 mm.

In embodiments, the wand 21 can have an internal casing 80 contained inside the wand 21. In embodiments, the internal casing 80 can be force fit within the wand 21.

The internal casing 80 can have a first chamber 82 and a second chamber 84.

In embodiments, the first chamber 82 can hold a power supply 26 and can be accessed by the removable detachable cap 23.

In embodiments, the power supply 26 can be a battery, a capacitor, a solar cell or combinations thereof.

The second chamber 84 can contain the on/off switch 28 and a motor 22. The on/off switch can be a pressure switch, which can be light pressure, operable by a child or an elderly person without much ability to apply pressure.

In embodiments, the second chamber 84 can be tapered at one end to contain the motor 22 in a snug fit.

In embodiments, the motor 22 can cycle for a predetermined duration when activated by the on/off switch 28. For example, the motor can operate for 5 minutes then shut off. In other embodiments, the motor can operate until it is powered off.

In embodiments, the motor 22 can be attached to an internal vibrating device 73.

The vibrating device 73 can be in mechanical communication with a stem. In embodiments, the vibrating device can include an eccentric weight 74 in mechanical communication with motor 22.

In other embodiments, the stem 71 can be offset on the vibrating device 73 providing the vibrating action needed to soothe the child's gums.

The mouth guard 40 can be connected to the wand 21 and can have a plurality of vents 42*a* and 42*b* formed therein for the comfort of the user.

The mouth guard 40 can also prevent a user from inserting the wand too far into their mouth, which could cause damage the user's throat or choking.

While two vents 42*a* and 42*b* are shown, more vents can be formed in the mouth guard 40. In embodiments, the diameter of each vent can range from about 1 cm diameter to about 2 cm diameter.

In embodiments, the mouth guard 40 can be molded to conform to lips of a user.

The detachable head 50 can extend longitudinally from the wand 21. The detachable head 50 can have at least one elevation 94 to allow a user to have an area to grip the detachable head 50 with their lips.

The at least one elevation 94 can have a height ranging from about 0.1 mm to about 0.5 mm from the surface of the detachable head 50.

In embodiments, the chew tip 60 can be configured to sustain a reduced temperature from room temperature if needed.

For example, the entire gum soother 10 can be placed in a refrigerator or freezer compartment of a home refrigerator/freezer and left to chill. Upon removal from the refrigerator/freezer the temperature of the gum soother 10 will have dropped, giving the user a cool wand to chew on, and providing a device that reduces inflammation of the gums.

The chew tip 60 can be connected to the detachable head 50.

In embodiments, the chew tip 60 can be heated or cooled dependent on the user's preference.

In embodiments, the chew tip 60 can have a length from about 1.5 cm to about 2.5 cm and a diameter from about 1 cm to about 1.5 cm.

The gum soother 10 can have a hollow body reducer 98 connecting between the mouth guard 40 and the motor 22. As an example, the hollow body reducer can narrow the outer diameter of the wand.

Figure 4:
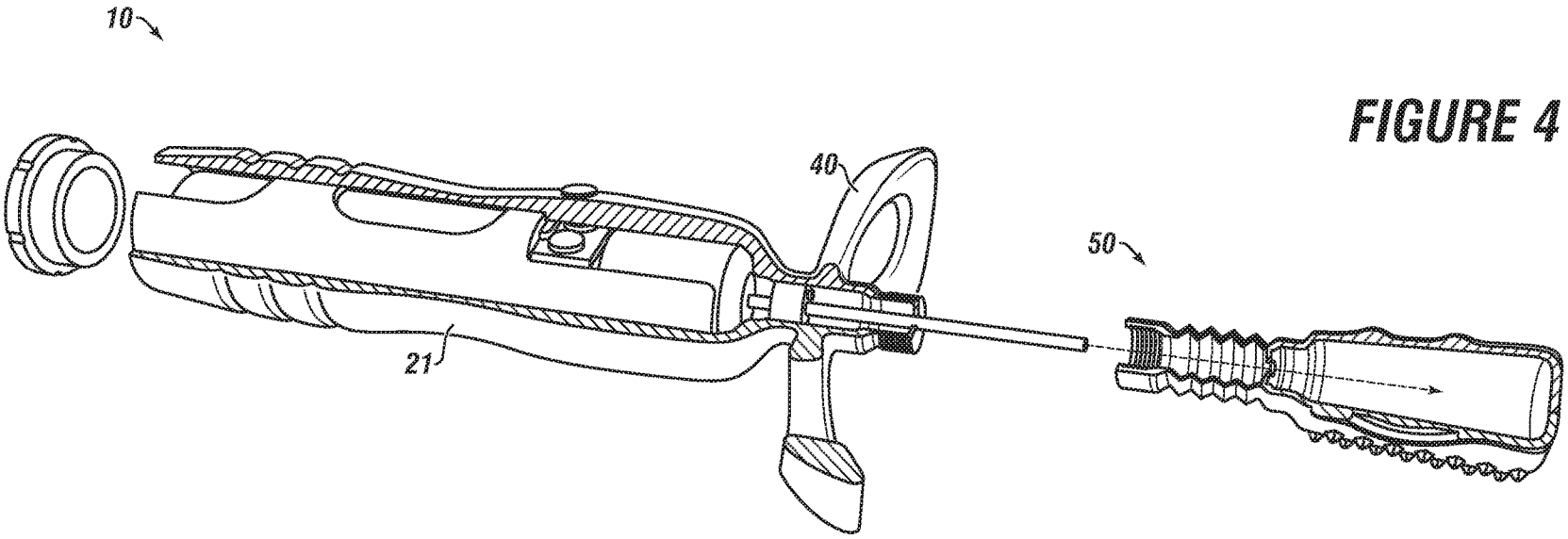
FIG. 4 shows an embodiment of the gum soother with the detachable head separated from the wand.

FIG. 4 shows an embodiment of the gum soother with the detachable head separated from the wand.

The gum soother 10 is shown with detachable head 50 removed from wand 21. While mouth guard 40 is shown attached to wand 21, in other embodiments the mouth guard 40 can be attached to detachable head 50.

Figure 5:
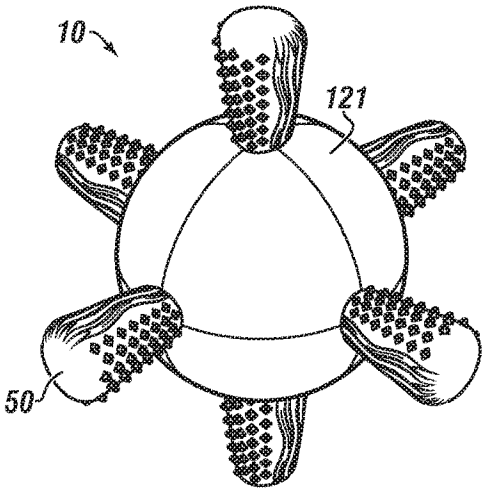
FIG. 5 shows an embodiment of the gum soother with a plurality of heads.

FIG. 5 shows an embodiment of the gum soother with a plurality of heads.

The gum soother can have a body 121 with a plurality of detachable heads 50 extending in various directions. A similar vibrating mechanism can be contained within the body 121 to vibrate the detachable head 50.

In embodiments, the body 121 can be attached and detachable from the wand, dependent upon use.

The body can be spherical, or various polyhedral shapes. Each detachable head can have a chew tip. The chew tips can be of uniform shape, or multiple shapes as desired. In embodiments, the chew tip can be detachable.

While these embodiments have been described with emphasis on the embodiments, it should be understood that within the scope of the appended claims, the embodiments might be practiced other than as specifically described herein.

What is claimed is:

1. A gum soother comprising:

a. a wand comprising:

(i) a motor;

(ii) a power supply connected to the motor;

(iii) a handle; and (iv) a vibrating device within the handle in mechanical communication with the motor;

b. a rotating stem in mechanical communication with the vibrating device extending from the wand, wherein the stem is configured to reach a gum located in the rear of a mouth; and c. a detachable head configured to be in mechanical communication with the stem.

2. The gum soother of claim 1, wherein the detachable head comprises a chew tip.

3. The gum soother of claim 1, wherein the detachable head comprises a chew tip configured to sustain a temperature cooler than ambient temperature.

4. The gum soother of claim 1, wherein the detachable head comprises a mouth guard.

5. The gum soother of claim 1, comprising an internal casing contained inside the wand having a chamber containing the power supply.

6. The gum soother of claim 1, wherein the power supply is at least one of: a battery, a solar cell, or a capacitor.

7. The gum soother of claim 1, comprising a charging port connected to the power supply for recharging the power supply and/or providing a USB port connection.

8. The gum soother of claim 4, comprising a plurality of vents formed in the mouth guard.

9. The gum soother of claim 1, comprising an ergonomic grip formed on an outer surface of the wand.

10. The gum soother of claim 1, further comprising a mouth guard, wherein the mouth guard is curved to conform to lips of a user.

11. The gum soother of claim 1, wherein the vibrating device comprises an eccentric weight.

12. The gum soother of claim 2, wherein the chew tip comprises a plurality of facets and a plurality of ridges mounted on an outer surface of the chew tip.

13. The gum soother of claim 10, wherein the mouth guard is attachable to the wand, attachable to the detachable head, or attachable to both the wand and the detachable head.

* * * * *